US008474591B1

(12) United States Patent
Coples

(10) Patent No.: US 8,474,591 B1
(45) Date of Patent: Jul. 2, 2013

(54) GARBAGE CHUTE APPARATUS

(76) Inventor: Donald D. Coples, Kinston, NC (US)

( * ) Notice: Subject to any disclaimer, the term of this patent is extended or adjusted under 35 U.S.C. 154(b) by 711 days.

(21) Appl. No.: 12/556,846

(22) Filed: Sep. 10, 2009

(51) Int. Cl.
*E04F 17/12* (2006.01)

(52) U.S. Cl.
CPC ..... *E04F 17/12* (2013.01)
USPC ..... 193/33

(58) Field of Classification Search
USPC ..... 193/2 R, 33, 34
See application file for complete search history.

(56) References Cited

U.S. PATENT DOCUMENTS

| | | | | | |
|---|---|---|---|---|---|
| 1,055,311 | A | * | 3/1913 | Blount | 193/30 |
| 2,792,171 | A | * | 5/1957 | Rosset | 232/43.3 |
| 3,071,867 | A | * | 1/1963 | Barber | 232/43.2 |
| 3,116,774 | A | * | 1/1964 | Callahan | 220/200 |
| 3,171,447 | A | * | 3/1965 | Fowler et al. | 141/95 |
| 3,554,345 | A | | 1/1971 | Mullens | |
| 3,664,576 | A | * | 5/1972 | Potvin | 232/43.2 |
| 3,881,408 | A | * | 5/1975 | Valor | 100/353 |
| 4,013,215 | A | | 3/1977 | Mercier | |
| D296,834 | S | | 7/1988 | McDermott | |
| 5,007,581 | A | | 4/1991 | Douglas | |
| 5,280,688 | A | | 1/1994 | Zoccoli | |
| 5,492,227 | A | * | 2/1996 | Millette et al. | 209/703 |
| 5,505,500 | A | * | 4/1996 | Webb et al. | 285/223 |
| 5,772,112 | A | | 6/1998 | Bulcroft | |

* cited by examiner

*Primary Examiner* — Gene Crawford
*Assistant Examiner* — William R Harp

(57) ABSTRACT

The garbage chute apparatus provides a chute of about 12 inches in diameter that is smooth with the rounded bend relatively gradual so that garbage items do no lodge within the chute or become trapped by any rough or uneven surfaces. The deodorizer within the chute further provides odor protection. The exhaust fan also prevents odor buildup. The coupler removably and sealably fits to the chute vertical leg via a hook and loop band, so that the coupling between the chute and coupler is leak proof with regard to odors and materials. The smooth bell-shaped coupler has no surfaces aberrations so that garbage items are not lodged, but pass straight through. The coupler opens widely at the bottom to allow for removable attachment to a plurality of garbage containers, with little regard to container size and shape. The elastic band seals the coupler to a given container.

5 Claims, 5 Drawing Sheets

GARBAGE CHUTE APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various devices have been proffered that provide a garbage chute between an indoor access and an exterior garbage container. Problems with such devices are not unknown. For example, many are relegated to the use of only a specific garbage container size and shape. Many of the devices are overly complex and thus overly expensive and difficult to install. More than one device previously offered contains convolutions within the chute or garbage container adapter that can trap trash and odors. Some devices do not seal the chute to the garbage, so that unpleasant odors are released into areas non-desirous of such. Some such devices do not have a chute diameter large enough to handle larger trash items. The previous devices proposed do not provide for ventilation of garbage odors. The present apparatus solves these problems.

FIELD OF THE INVENTION

The garbage chute apparatus relates to garbage chutes and more especially to a garbage chute apparatus that provides a flexible sealed closure between the chute and garbage can and an exhaust fan to vacate unpleasant garbage odors.

SUMMARY OF THE INVENTION

The general purpose of the garbage chute apparatus, described subsequently in greater detail, is to provide a garbage chute apparatus which has many novel features that result in an improved garbage chute apparatus which is not anticipated, rendered obvious, suggested, or even implied by prior art, either alone or in combination thereof.

To attain this, the garbage chute apparatus provides a chute of about 12 inches in diameter so that relatively large garbage items can be transferred there through. The chute is smooth and the rounded bend is relatively gradual so that garbage items do no lodge within the chute or become trapped by any rough or uneven surfaces. The deodorizer within the chute further provides odor protection. The exhaust fan also prevents odor buildup. The round door provides aesthetic appeal for the room interior.

The coupler removably and sealably fits to the chute vertical leg via a hook and loop band, so that the coupling between the chute and coupler is leak proof with regard to odors and materials.

The smooth bell-shaped coupler has no surfaces aberrations so that garbage items are not lodged, but pass straight through. The coupler opens widely at the bottom to allow for removable attachment to a plurality of garbage containers, with little regard to container size and shape. The elastic band seals the coupler to a given garbage container.

Thus has been broadly outlined the more important features of the improved garbage chute apparatus so that the detailed description thereof that follows may be better understood and in order that the present contribution to the art may be better appreciated.

An object of the garbage chute apparatus is to convey garbage from an interior room to a garbage container exterior to the room.

Another object of the garbage chute apparatus is to provide for conveying relatively large garbage items.

A further object of the garbage chute apparatus is to provide for no odor transfer back into the interior room.

Another object of the garbage chute apparatus is to provide forced ventilation escape of any garbage odors.

An added object of the garbage chute apparatus is to provide a positive sealed coupling between the chute and the garbage container.

And, an object of the garbage chute apparatus is to provide a smooth connection between the chute and the garbage container so that garbage and odors are not trapped.

Yet another object of the garbage chute apparatus is to provide a chute-to-container coupling that fits various sizes and shapes of garbage containers.

These together with additional objects, features and advantages of the improved garbage chute apparatus will be readily apparent to those of ordinary skill in the art upon reading the following detailed description of presently preferred, but nonetheless illustrative, embodiments of the improved garbage chute apparatus when taken in conjunction with the accompanying drawings.

In this respect, before explaining the current embodiments of the improved garbage chute apparatus in detail, it is to be understood that the garbage chute apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved garbage chute apparatus. It is therefore important that the claims be regarded as including such equivalent constructions insofar as they do not depart from the spirit and scope of the garbage chute apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the garbage chute apparatus generally designated by the reference number 10 will be described.

Figure 1:
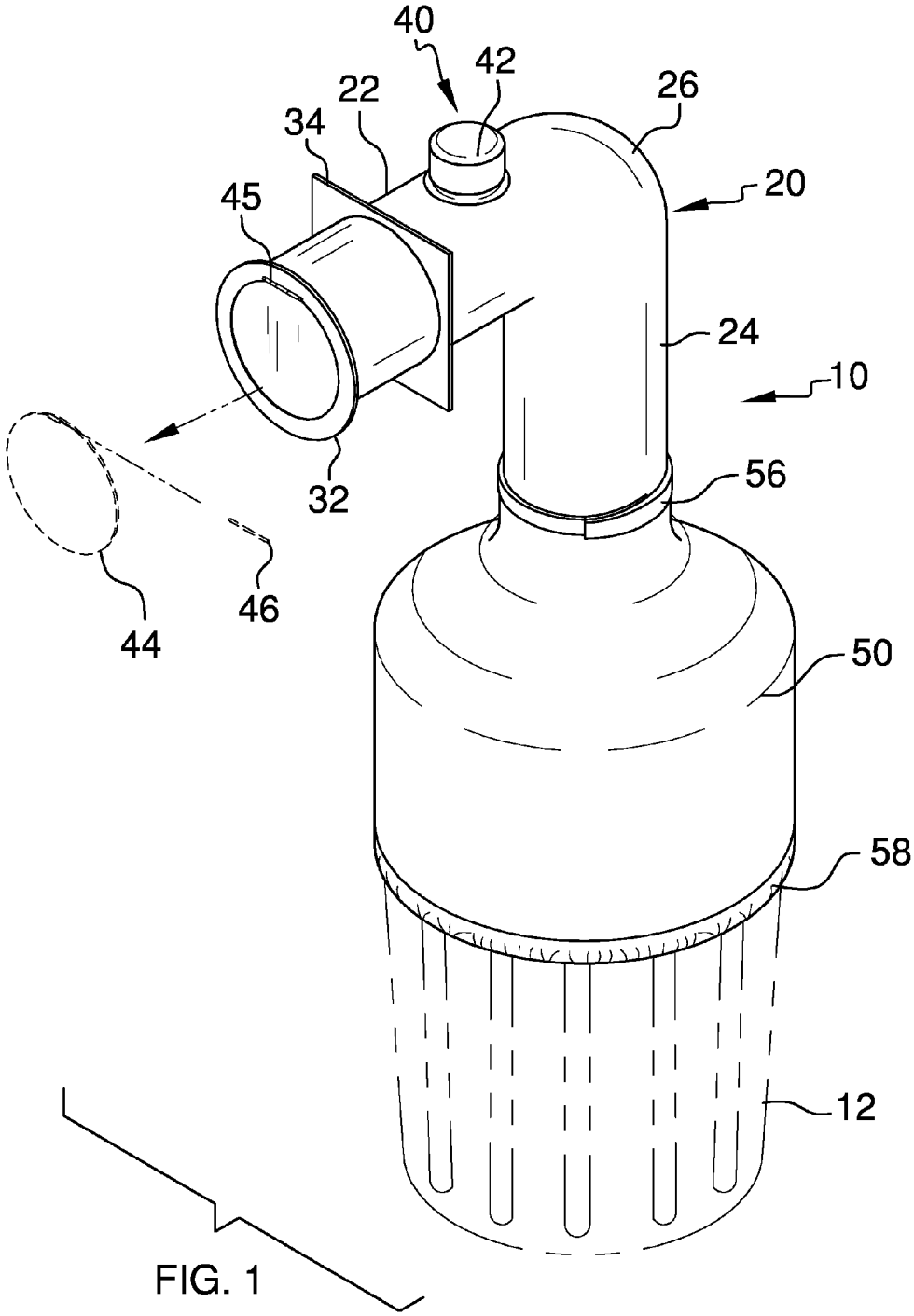
FIG. 1 is a perspective view of the apparatus fitted to a garbage container.
Figure 2:
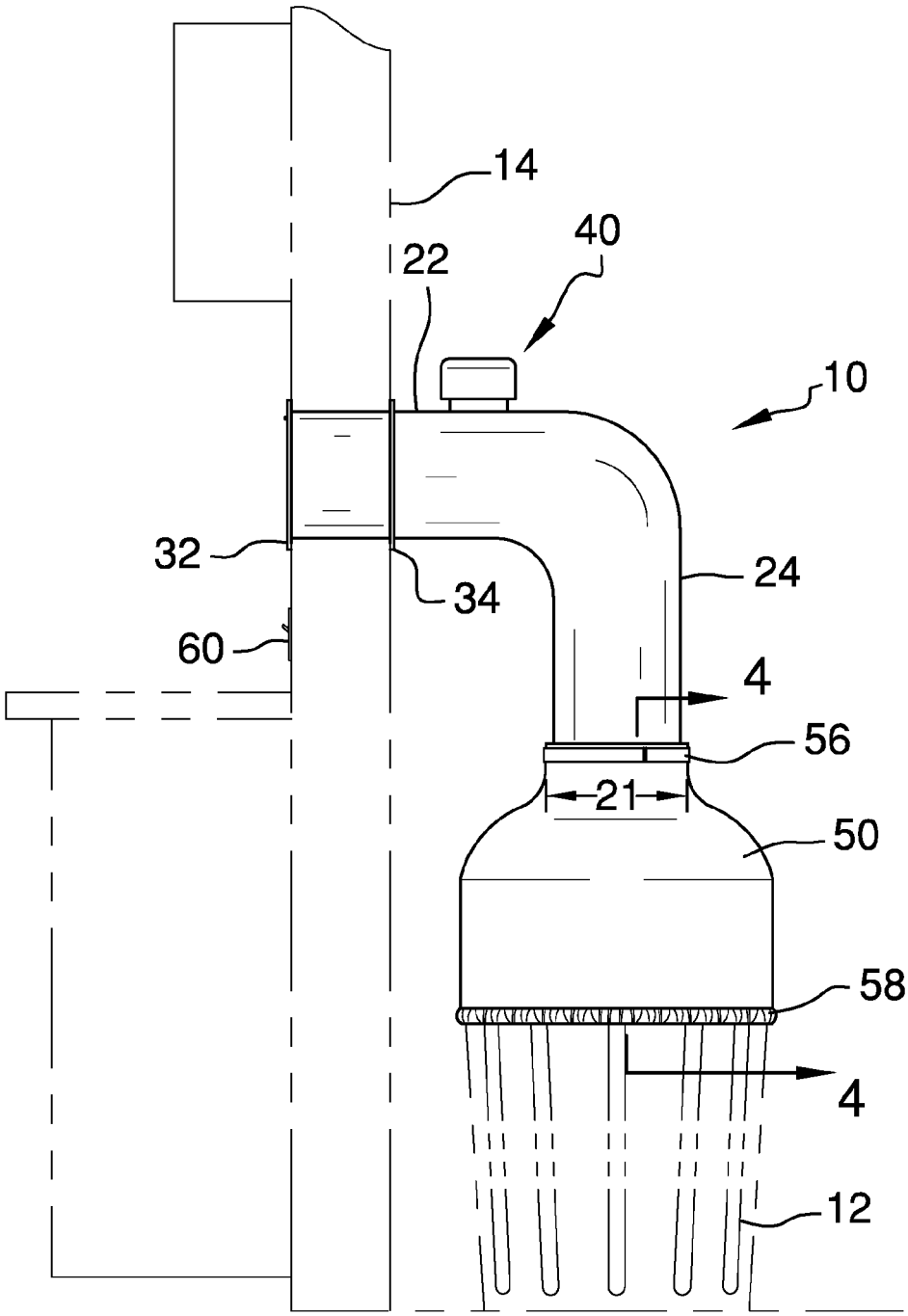
FIG. 2 is a lateral view of the installed apparatus.
Figure 3:
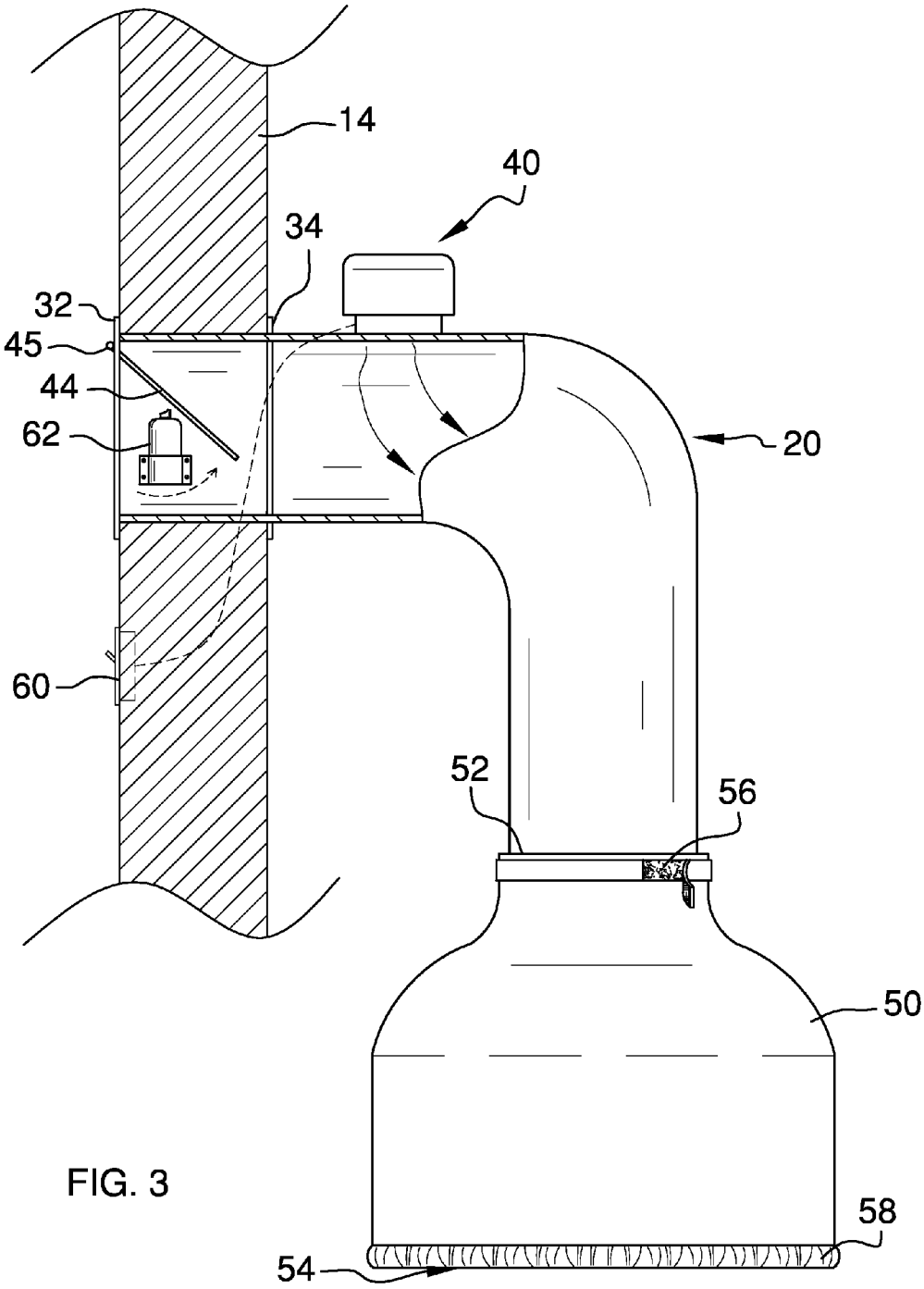
FIG. 3 is a lateral view of the installed apparatus, with a partial cross section.

Referring to FIGS. 1-3, the apparatus 10 partially comprises the chute 20 having a chute diameter 21 of about 12 inches. The chute 20 comprises a horizontal leg 22 connected to a vertical leg 24 by a rounded bend 26. The horizontal leg 22 is fitted through an existing wall 14. A circular inner flange 32 is disposed on the horizontal leg 22. An outer flange 34 is disposed on the horizontal leg 22 in parallel with the inner flange 32. The inner flange 32 is placed against the interior of the existing wall 14. The outer flange 34 is placed against the exterior of the existing wall 14. The inner flange 32 and the outer flange 34 seal the horizontal leg 22 within the wall 14. The round door 44 is disposed on the outer flange 32. The door 44 is attached via an inwardly pivoting hinge 45 with a removable hinge pin 46 so that the door 44 can be removed for cleaning the door 44 and chute 20. The exhaust fan 40 is affixed to the horizontal leg 22. The exhaust fan 40 is positioned exteriorly to the outer flange 34. The fan cover 42 is mounted atop the exhaust fan 40.

Figure 5:
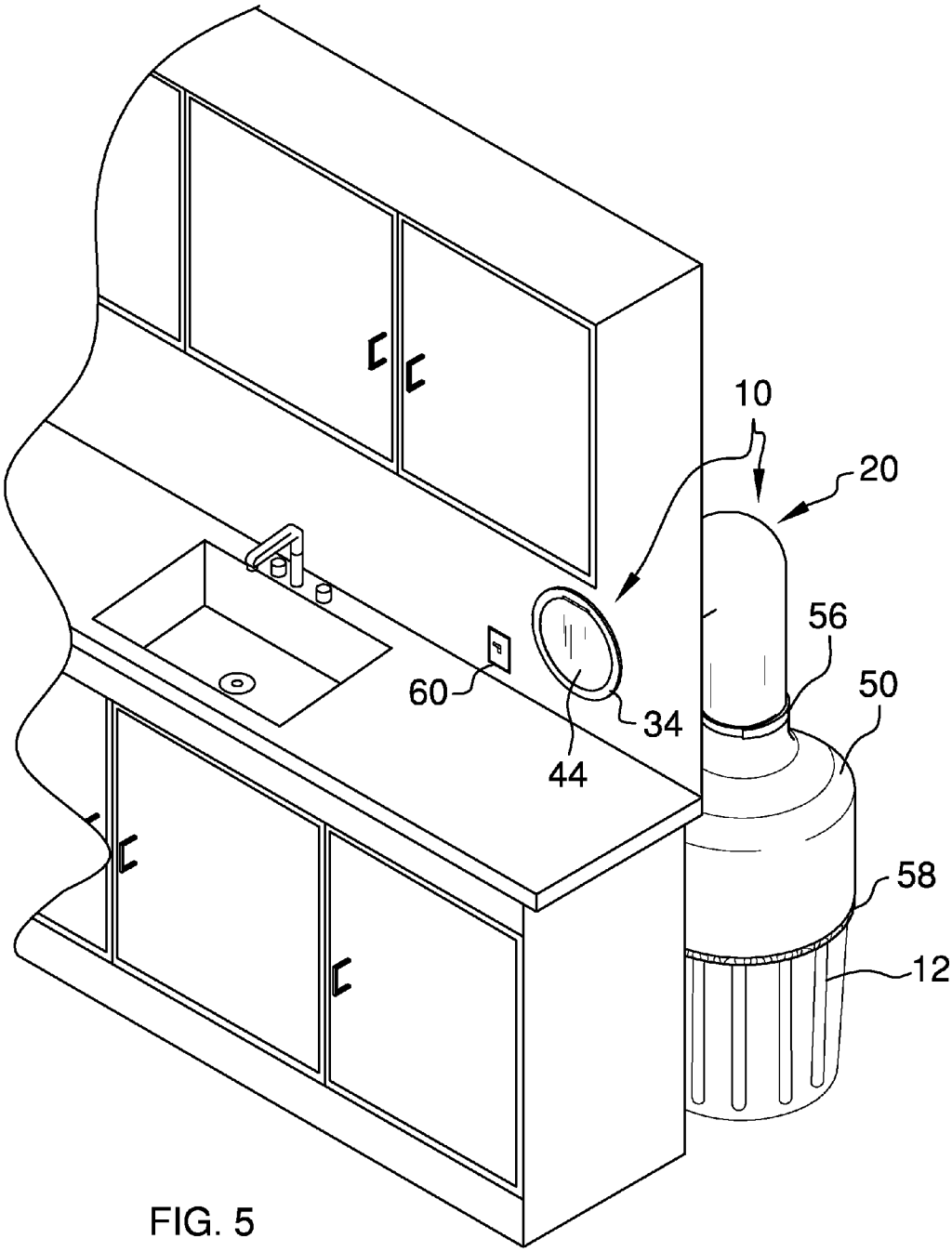
FIG. 5 is a perspective view of the installed apparatus.

Referring to FIGS. 2, 3, and 5, the timed switch 60 is in communication with the exhaust fan 40. The timed switch 60 is mounted as chosen, with the wall 14 interior being ideal for most. The timed switch 60 can be set for fan operation for a given period of time to ensure odor removal from the chute 20 and the garbage container 12. The deodorizer 62 is mounted within the horizontal leg 22 between the inner flange 32 and the outer flange 34.

Figure 4:
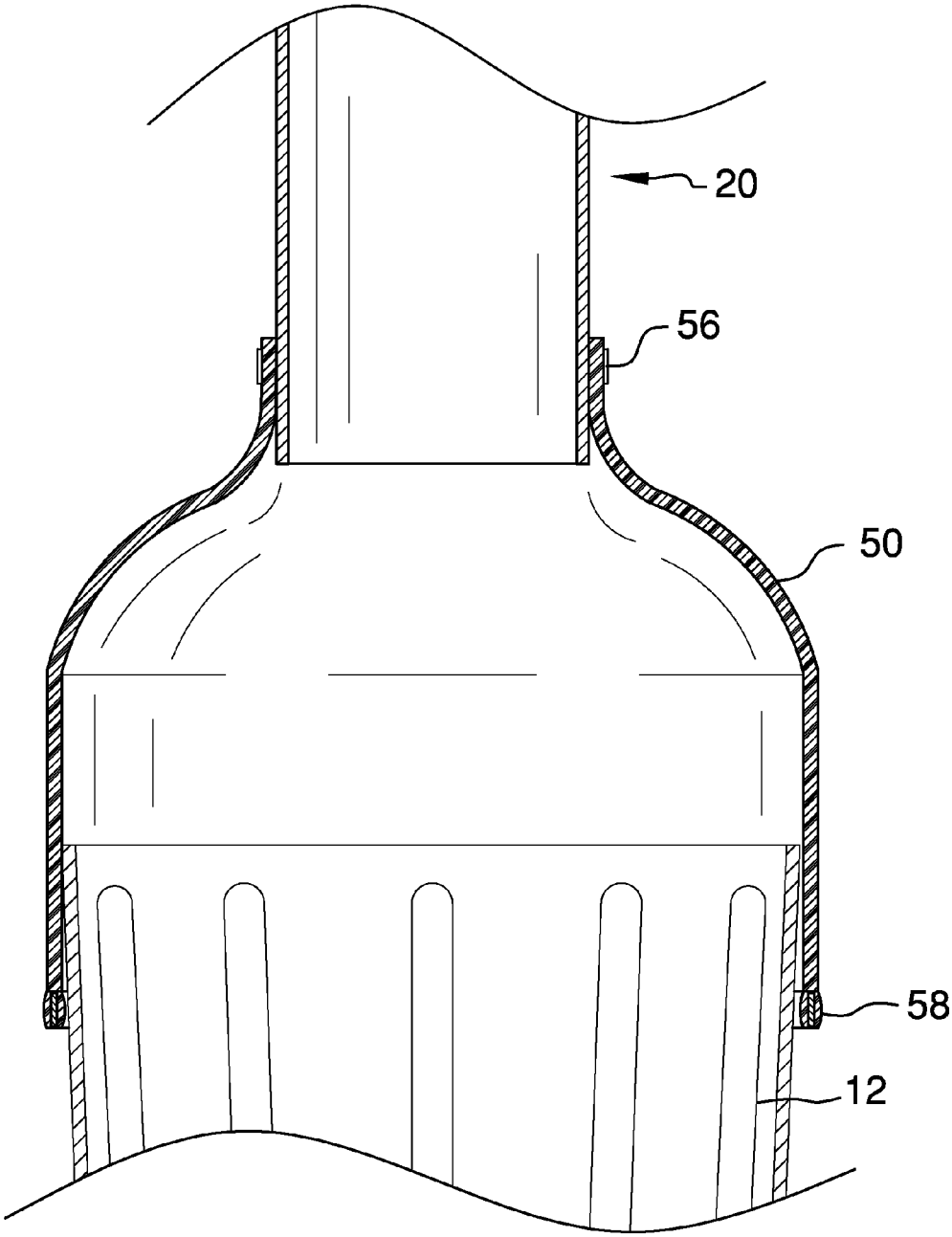
FIG. 4 is a cross sectional view of the coupler connecting the chute to the garbage container.

Referring to FIGS. 1 and 4, the flexible smooth bell-shaped coupler 50 removably couples the chute 20 vertical leg 24 to an existing garbage container 12. The coupler 50 has a top 52 spaced apart from a bottom 54. The hook and loop band 56 is disposed around the top 52. The elastic band 58 is disposed around the coupler bottom 54. The hook and loop band 56 removably sealably fits the top 52 to the chute 20 vertical leg 24. The elastic band 58 removably sealably fits the coupler 50 bottom 54 to the garbage container 12.

With respect to the above description then, it is to be realized that the optimum dimensional relationships for the parts of the garbage chute apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the garbage chute apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the garbage chute apparatus may be used.

Therefore, the foregoing is considered as illustrative only of the principles of the garbage chute apparatus. Further, since numerous modifications and changes will readily occur to those skilled in the art, it is not desired to limit the garbage chute apparatus to the exact construction and operation shown and described, and accordingly, all suitable modifications and equivalents may be resorted to, falling within the scope of the garbage chute apparatus.

What is claimed is:

1. A garbage chute apparatus, comprising, in combination:

a chute having a chute diameter of about 12 inches, the chute comprising a horizontal leg connected to a vertical leg by a rounded bend;

an outer flange disposed on the horizontal leg;

an inner flange disposed in parallel with the outer flange on the horizontal leg, the inner flange placed against an interior of an existing wall, the outer flange placed against an exterior of the existing wall, said inner and outer flanges sealing the horizontal leg within the wall;

a round door disposed on the inner flange, the door attached via an inwardly pivoting hinge;

an exhaust fan affixed to the horizontal leg, the exhaust fan positioned exteriorly to the outer flange;

a fan cover mounted atop the exhaust fan;

a mountable switch in communication with the exhaust fan;

a flexible smooth bell-shaped coupler removably coupling the chute vertical leg to an existing garbage container, the coupler having a top spaced apart from a bottom;

a hook and loop band around the coupler top;

an elastic band around the coupler bottom, the hook and loop band and the elastic band sealably fitting the coupler to the chute and to the garbage container.

2. The apparatus according to claim 1 wherein the hinge further comprises a removable hinge pin whereby the door can be removed.

3. The apparatus according to claim 1 wherein the switch further comprises a timed switch.

4. The apparatus according to claim 2 wherein the switch further comprises a timed switch.

5. A garbage chute apparatus, comprising, in combination:

a chute having a chute diameter of about 12 inches, the chute comprising a horizontal leg connected to a vertical leg by a rounded bend;

a circular outer flange disposed outwardly on the horizontal leg;

an inner flange disposed on the horizontal leg, the inner flange placed against an interior of an existing wall, the outer flange placed against an exterior of the existing wall, the flanges sealing the horizontal leg within the wall;

a round door disposed on the outer flange, the door attached via an inwardly pivoting hinge with a removable hinge pin;

an exhaust fan affixed to the horizontal leg, the exhaust fan positioned exteriorly to the outer flange;

a fan cover mounted atop the exhaust fan;

a mountable timed switch in communication with the exhaust fan;

a deodorizer mounted within the horizontal leg between the inner flange and the outer flange;

a flexible smooth bell-shaped coupler removably coupling the chute vertical leg to an existing garbage container, the coupler having a top spaced apart from a bottom;

a hook and loop band around the coupler top;

an elastic band around the coupler bottom, the hook and loop band and the elastic band sealably fitting the coupler to the chute and to the garbage container.

* * * * *